US006085454A

United States Patent [19]

Caudle

[11] Patent Number: 6,085,454

[45] Date of Patent: Jul. 11, 2000

[54] MODULAR LOAD UNIT FOR MUZZLE LOADING FIREARMS

[76] Inventor: Carl E. Caudle, P.O. Box 6, Moses Lake, Wash. 98837

[21] Appl. No.: 08/928,709

[22] Filed: Sep. 11, 1997

[51] Int. Cl.[7] ..... F41A 15/00

[52] U.S. Cl. ..... 42/90; 42/51

[58] Field of Search ..... 42/90, 51

[56] References Cited

U.S. PATENT DOCUMENTS

| | | | |
|---|---|---|---|
| 4,862,623 | 9/1989 | Delap et al. | 42/90 |
| 5,094,024 | 3/1992 | Duke | 42/90 |
| 5,164,539 | 11/1992 | French | 102/520 |
| 5,621,187 | 4/1997 | Kearns | 102/520 |

OTHER PUBLICATIONS

"Quick Shot Instructions" Thompson/Center Arms Co., Inc., P.O. Box 5002, Rochester, New Hampshire 03866–5002.

(Untitled), p. 78 Illustration of paper cartridges. Source unknown.

"Paper Cartridges for Muzzle–Loaders," pp. 329–332. Source unknown.

*Primary Examiner*—Charles T. Jordan

*Assistant Examiner*—Chris J Brown

*Attorney, Agent, or Firm*—Stratton Ballew PLLC

[57] ABSTRACT

A modular load unit that is received in a muzzle loading firearm having a bore and a rifling defined therein. The modular load unit has a hull, a projectile in a projectile receiving compartment, a projectile retaining cap removably received over the projectile, a cushion, a propellant in a propellant receiving compartment, and a propellant retaining cap removably received over the propellant. The modular load unit can be inserted into the bore of the muzzle loading firearm at any angle. Upon firing of the muzzle loading firearm, the cushion and the propellant receiving compartment sealingly engage the rifling.

20 Claims, 12 Drawing Sheets

MODULAR LOAD UNIT FOR MUZZLE LOADING FIREARMS

TECHNICAL FIELD

The present invention relates to the field of firearms. More particularly, the invention pertains to a modular unit and method for loading a muzzleloader which ensures improved ballistic performance, safety, accuracy, and convenience; allows faster reloading; allows self-cleaning; increases weather-resistance; and eliminates the traditional gravity feed operation and the possibility of projectile deformation.

BACKGROUND OF THE INVENTION

The class of firearms known as muzzleloader is old and well known. Shooting muzzleloading guns of all types has become a pastime of considerable and growing importance. Returning to a simpler way of life is one of the lures of muzzleloading; however, using a muzzleloader is not as simple as it could be. The muzzleloader is characterized by the method of loading where a propellant charge and a projectile are each individually loaded through the bore and into the chamber of the barrel through a gravity feed operation. In this class of firearms, a separate source of ignition is provided for igniting the charge. The distance and accuracy of each shot fired from a muzzleloader is dependent upon the way the gun is loaded, and yet it is nearly impossible, with current methods, to load a muzzleloader exactly the same every time.

For centuries, black powder or muzzleloader weapons have been loaded by hand with powder, patch and projectile. The barrel has traditionally served as a cartridge hull or case, keeping the components together. Gravity is relied upon to position the powder and projectile in the muzzleloader's barrel.

The traditional materials needed for firing a muzzleloader include percussion caps, powder, conical bullet or ball, powder measure and patching. With a flintlock-style firearm, the percussion caps are not necessary. The traditional method of loading the muzzleloader begins by determining that the bore is clean, and dry, and free of grease or oil, which can gum up the system. Next, the nipple or vent, which directs the ignition spark toward the charge, is inspected to make sure it is clear of fouling from a previous shot. With a percussion-style firearm, it is customary to snap a cap on the empty chamber to dry and clear the ignition passageway. A proper charge of powder is then measured and poured directly down the center of the bore. Then, the sides of the barrel are impacted with an open hand to settle the powder in the breech; alternatively, the butt of the stock is impacted on the ground to achieve the same results.

Next, a lubricated patch is placed over the muzzle and a ball is positioned on the patch at the bore opening. Any excess patching is trimmed off. Using the ramrod, the ball is forced down the bore and onto the powder charge with an even, steady pressure. Steady, even pressure is required to avoid deforming the ball, which can lead to poor ballistic performance and inaccurate shooting. Any air space left between the powder and the ball must be eliminated to avoid uneven burning and inaccurate shooting. When the ball is seated, the ramrod is removed.

Muzzle loading firearms utilize a flint or an ignition cap which contains an ignitable substance to ignite the charge. Upon ignition of the propellant charge there is a rapid and large increase in pressure within the chamber, which causes the projectile to be propelled down the length of the bore and out the barrel at a high velocity. At the same time, some of the hot gases and debris from the ignition are directed backward due to the inertia of the projectile.

The problems associated with loading a muzzleloader include the following: 1) each load is put down the bore by hand, relying on gravity to position the load properly; 2) sloppy or inconsistent loading practices increase the risk of dangerous accidents; 3) sloppy or inconsistent loading practices decrease shooting accuracy; 4) the components of each load, which must be held outside the gun at least briefly prior to loading, can be detrimentally affected by weather, the shooter's carelessness, cleanliness and storage techniques; and 5) when using a muzzleloader to hunt game, it is necessary to fire and reload quickly.

Consistent loading is difficult because each step is performed by hand. The powder charge must be measured and poured into the barrel for each shot; the size and placement of the patching must be uniform; the ball must be seated with the same pressure each time. When these factors vary from shot to shot, as they most certainly will, velocity, uniformity, and shooting accuracy are affected. More importantly, the shooter risks injury from the improperly loaded gun.

For instance, the powder charge must be measured very carefully with each load to obtain a uniform charge. Because uniformity is so crucial, powder measures were introduced for preparing the optimum load. A powder measure is used by pouring the powder into the measure, tapping the barrel of the measure a specific number of times, and then leveling the charge. The process is repeated exactly with every load. While this process may help to get a more uniform charge for every load, the user must still get the powder into the barrel, relying solely on gravity to position it properly. The other components must then be assembled in the proper ratio and order.

Attempts have been made to simplify the assembly of the muzzleloader charge components. For instance, a combustible paper-case cartridge design was available as early as 1860. The success of this type of cartridge is dependent upon the nitroglycerin-impregnated paper igniting quickly, without smoldering. Cartridges of this type are dangerous to the health of the user. Because the paper case is typically torn off by mouth, ingestion of nitroglycerin can easily occur. There are other disadvantages associated with paper cartridges: the paper is fragile; the projectiles tend to be oversized for such cartridges; the cartridge is difficult to ignite; the cartridge is unusable if it becomes damp; and the cartridge is dangerous to handle and use.

During ignition of a muzzleloader charge, the base and the nose of the projectile tend to compress towards the center, deformating the projectile. With traditional methods of US loading a muzzleloader, the ball or projectile will be further deformed each time the load is packed with the ramrod. When the projectile is deformed, the direction of the projectile upon firing is unpredictable.

The safety and the speed of loading can be significantly increased by utilizing a modular load unit designed to hold an optimum measured charge. By eliminating the need for loose powder, which is spark sensitive, unintentional ignitions or explosions are prevented. By preventing deformation of the projectile at ignition, additional safety benefits are gained.

By having uniformity through use of a modular load unit, there are no surprises for the hunter or target shooter utilizing a muzzleloader. The modular load unit delivers optimum, safe loads with every shot. Traditionally and currently there exists an element of speculation with each shot fired from a muzzleloader.

Therefore, a need exists for a modular load unit that eases the loading process by storing optimum amounts of individual components safely and properly arranged, which can be quickly and easily inserted in its entirety into the barrel of the firearm.

SUMMARY OF INVENTION

The present invention provides a modular load unit for being received into a muzzle loading firearm. The modular load unit includes a hull body having a first end and a second end; a projectile receiving compartment defined in the first end of the hull body; a propellant receiving compartment defined in a second end of the hull body; and a cushion positioned between the propellant receiving compartment and the projectile receiving compartment.

In an embodiment, the projectile receiving compartment, the propellant receiving compartment and the cushion are integral with the hull body.

In an embodiment, the modular load unit includes a projectile received within the projectile receiving compartment; a projectile retaining cap removably received over the projectile; a propellant received within the propellant receiving compartment; and a propellant retaining cap removably received over the second end of the hull body of the modular load unit.

In another embodiment, the projectile receiving compartment is cup-shaped.

In still another embodiment, the cup-shaped projectile receiving compartment includes at least one removable breakaway side which breaks away from the projectile receiving compartment, releasing the projectile when the muzzle loading firearm is fired.

In another embodiment, the cup-shaped projectile receiving compartment includes at least one peelaway side which peels away from the cup, releasing the projectile when the muzzle loading firearm is fired.

In another embodiment, the projectile receiving compartment is constructed from a polymer and the propellant receiving compartment is constructed from a polymer with greater thermostability than the polymer forming the projectile receiving compartment.

In another embodiment, the propellant received within the propellant receiving compartment is a pellet of compressed propellant charge.

In an embodiment, the pellet received in the propellant receiving compartment is compressed blackpowder having a center with a hole bored through the center.

The present invention provides a modular load unit receivable in a muzzle loading firearm having a barrel with a bore and a rifling defined therein. The bore has a bore diameter and the rifling has a rifling diameter greater than the bore diameter. The modular load unit includes a hull body having a first end and a second end; a projectile receiving compartment defined in the first end of the hull body; an expandable propellant receiving compartment defined in the second end of the hull body, the propellant receiving compartment having a propellant loading diameter and a propellant firing diameter, the propellant loading diameter substantially equal to the bore diameter of the muzzle loading firearm and the propellant firing diameter substantially equal to the rifling diameter of the muzzle loading firearm such that the modular load unit sealingly engages the rifling diameter of the muzzle loading firearm upon firing the muzzle loading firearm; and an expandable cushion defined in the hull body, positioned between the propellant receiving compartment and the projectile receiving compartment, the cushion having a cushion loading diameter and a cushion firing diameter. The cushion loading diameter is substantially equal to the bore diameter and the cushion firing diameter is substantially equal to the rifling diameter such that the cushion sealingly engages the rifling diameter upon firing of the muzzle loading firearm.

In an embodiment, the hull body is formed from a polymer.

In an embodiment, the projectile retaining cap is constructed from a brittle material.

The present invention provides a method for loading a muzzle loading firearm having a barrel with a bore and a breech plug. The method includes the steps of: removing a removable propellant retaining cap from a modular load unit having a hull body with a first end and a second end, a projectile, a cushion, a propellant and a projectile retaining cap having a center with a hole bored through the center of the projectile retaining cap, the projectile retaining cap removably seated over the projectile; inserting the modular load unit into the bore with the second end of the hull body placed into the bore first; ramming a ramrod through the center of the projectile retaining cap and through to the first end of the hull body of the modular load unit to seat the modular load unit against the breech plug of the muzzle loading firearm; and withdrawing the ramrod and the projectile retaining cap.

The present invention provides a modular load unit for being received into a muzzle loading firearm having a barrel with a bore and a rifling defined therein. The bore has a bore diameter, and the rifling has a rifling diameter greater than the bore diameter. The modular load unit has a loading diameter and a firing diameter. The loading diameter is substantially equal to the bore diameter and the firing diameter is substantially equal to the rifling diameter such that the modular load unit sealingly engages the rifling when the muzzle loading firearm is fired. The modular load unit includes a hull body having a first end and a second end; a projectile receiving compartment defined in the first end of the hull body; a propellant receiving compartment defined in a second end of the hull body; a cushion positioned between the propellant receiving compartment and the projectile receiving compartment; a projectile received within the projectile receiving compartment of the modular load unit; and a propellant received within the propellant receiving compartment of the modular load unit.

In an embodiment, the modular load unit includes a projectile retaining cap removably received over the first end of the hull body and a propellant retaining cap removably received over the second end of the hull body of the modular load unit.

In an embodiment, the cushion is constructed from an elastomer.

It is, therefore, an advantage of the present invention to provide a modular load unit for muzzle loading firearms and a method of loading a muzzle loading firearm.

An advantage of the present invention is to provide a device that completely eliminates the requirement for gravity when loading a muzzleloader.

Another advantage of the present invention is to provide a device that greatly reduces barrel fouling.

Another advantage of the present invention is to provide a device that cleans the bore with each use.

Still another advantage of the present invention is to provide a highly accurate projectile which is concentrically aligned in the bore of the muzzle.

Another advantage of the present invention is to provide an extremely simple and fast reload for muzzleloaders.

Another advantage of the present invention is to provide a device that eliminates messy and dangerous loose components stored prior to loading a muzzleloader.

Another advantage of the present invention is to provide a device that increases ballistic performance.

Another advantage of the present invention is to provide a device that can be manufactured for a variety of projectiles.

Another advantage of the present invention is to provide a device that can be used in all models of muzzleloaders.

Still another advantage of the present invention is to provide a method of loading a muzzleloader at any angle.

Another advantage of the present invention is to provide a device and method for loading a muzzleloader that eliminates projectile deformation upon ignition.

Another advantage of the present invention is to reduce friction as the projectile passes out of the bore.

Another advantage of the present invention is to allow use of projectiles previously unusable with muzzle loading firearms.

Still another advantage of the present invention is to provide a device and a method for loading a muzzle loading firearm which is extremely convenient for the sport or activity of pursuing game.

BRIEF DESCRIPTION OF DRAWINGS

FIG. 22 also illustrates the projectile retaining cap falling away as the ramrod is withdrawn from the gun barrel.

DETAILED DESCRIPTION OF SPECIFIC EMBODIMENTS

Figure 21:
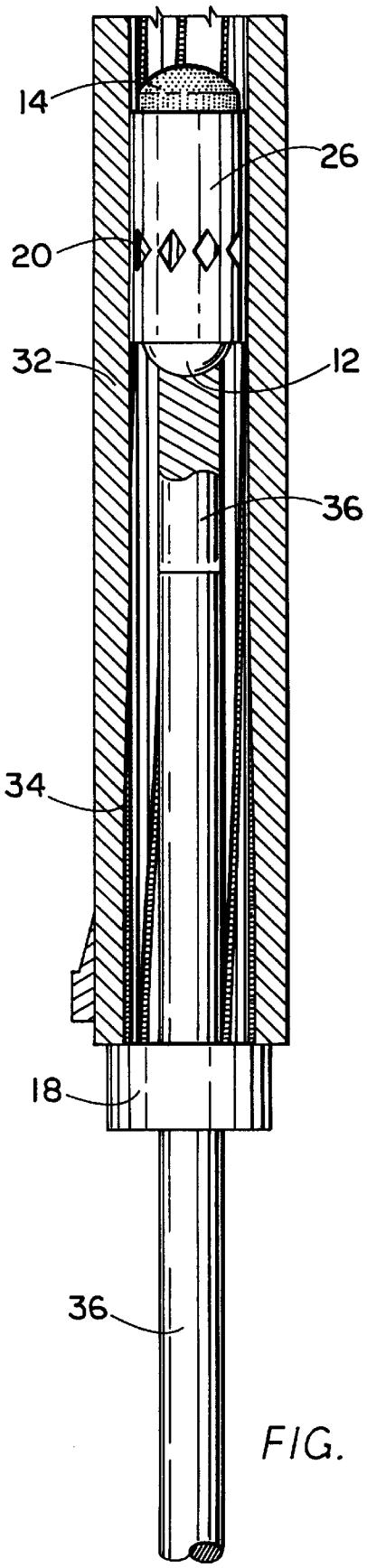
FIG. 21 is a partially sectioned view of a modular load unit with a projectile retaining cap being loaded with a ramrod into a gun barrel.
Figure 22:
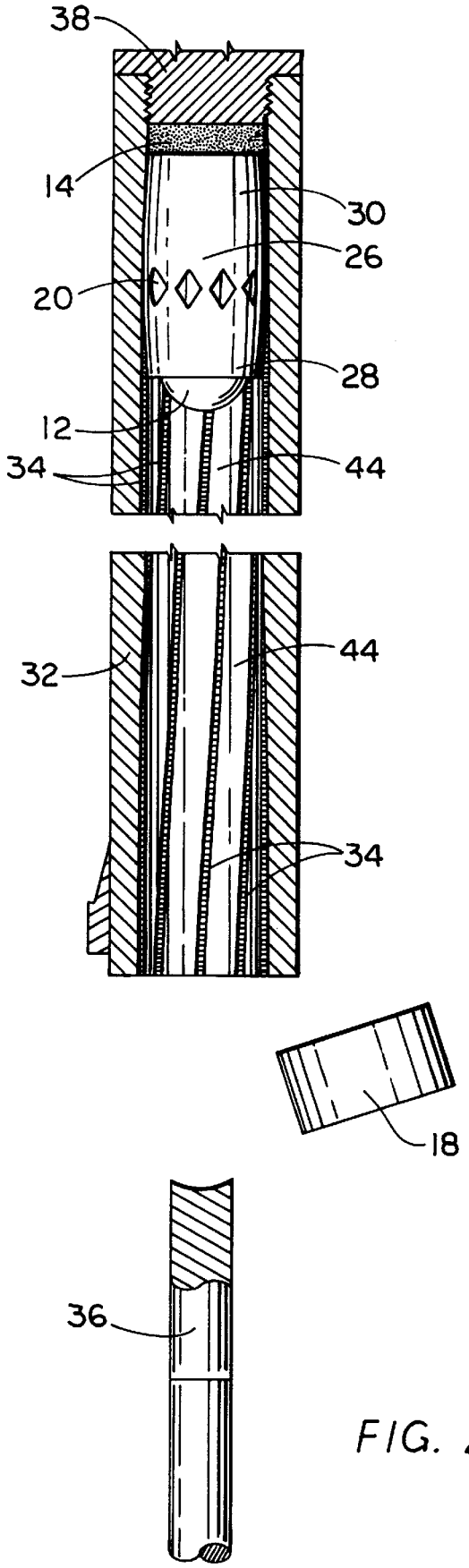
FIG. 22 is a partially sectioned view of a fully loaded modular load unit against a breech plug, illustrating the crushed propellant and the modular load unit expanded into the rifling.

With reference to FIGS. 1–10 and 14–24, a modular load unit 10 is shown, the modular load unit comprising a hull body 26, a projectile receiving compartment 24, a propellant receiving compartment 22, and a cushion 20. The modular load unit is received in a muzzle loading firearm (not shown), which includes a barrel 32 with a bore 44 having rifling grooves 34, as shown in FIGS. 19–22. With reference to FIG. 22, the bore has a breech plug 38. The breech plug is a threaded plug, typically made out if metal, which is screwed into the breech (not shown) as a seal at the rear of the bore where the charge is held. The bore has a bore diameter. The rifling grooves have a rifling diameter which is greater than the bore diameter. The hull body of the modular load unit has a diameter which is substantially the same as the bore diameter of the barrel.

Figure 1:
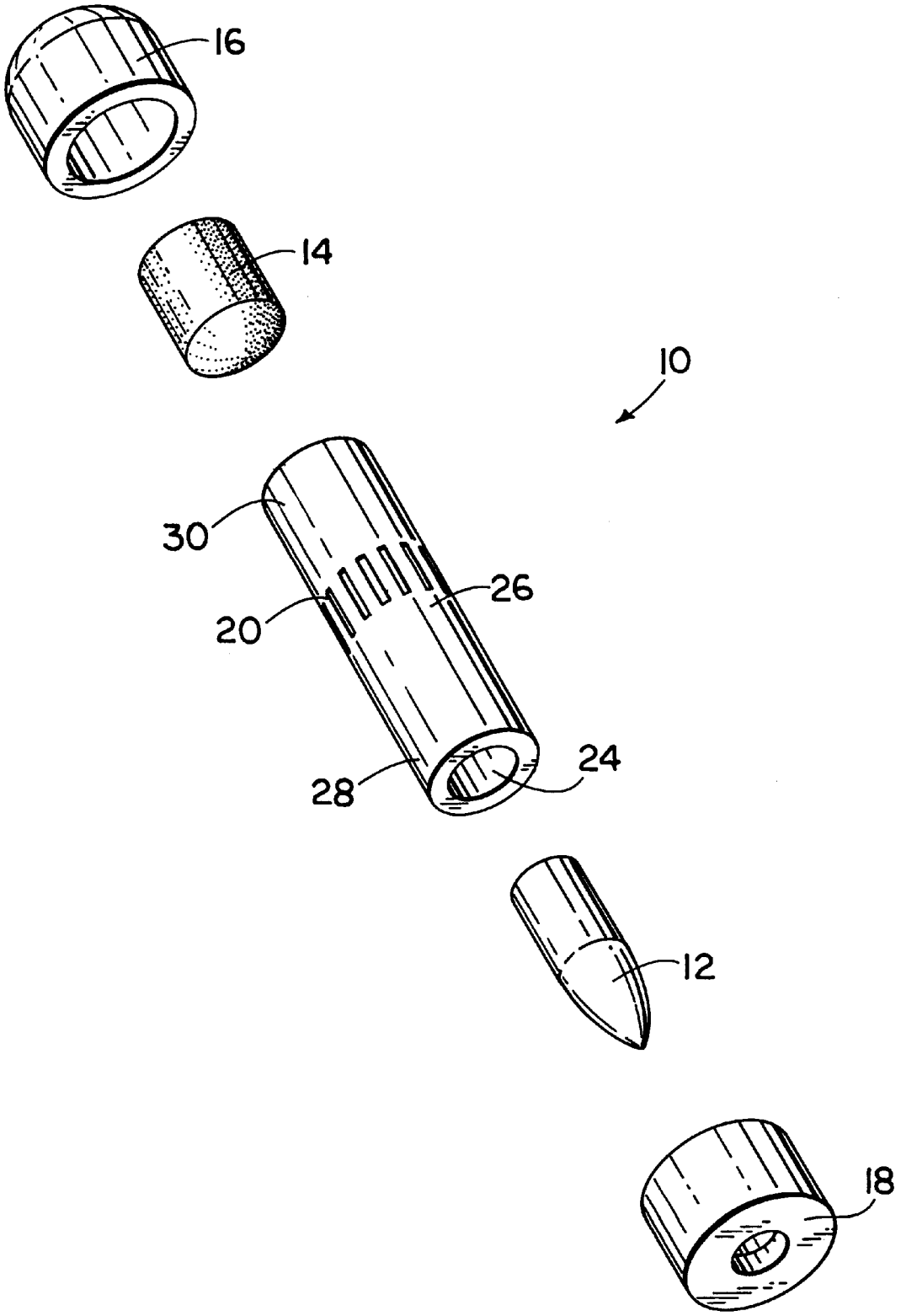
FIG. 1 is an exploded perspective view of a modular load unit with a propellant retaining cap and a projectile retaining cap.

With reference to FIG.1, the hull body 26 of the modular load unit 10 is elongated and cylindrical and has a first end 28 and a second end 30. The modular load unit has a low friction coefficient which optimizes ballistic performance, and can be constructed from a variety of different materials. For example, polymers, polyethylene, plastics, fiberglass, rubbers, metals, plant, i.e. cork, wood, cellulosics, composites, or any combinations or derivatives thereof may be used. In a preferred embodiment, the hull body of the modular load unit is a molded configuration created through gas or vacuum formed injection molding techniques. In a preferred embodiment, the hull body of the modular load unit is constructed from polymers.

A propellant receiving compartment 22 is defined in the second end 30 of the hull body 26 as shown in FIGS. 3–5, and 14–18. With reference to FIG. 22, the propellant receiving compartment expands into the rifling grooves 34 when a propellant 14 is crushed during the loading procedure. The propellant receiving compartment can be constructed from a variety of materials. For example, polymers, polyethylene, plastics, i.e. thermosetting plastics, fiberglass, rubbers, metals, plant, i.e. cork, wood, cellulosics, composites and or any combination or derivatives thereof may be used. In a preferred embodiment, the propellant receiving compartment is constructed from a polymer material which can withstand an extremely high temperature due to the fact that deflagrating powder (black powder) burns at approximately 801 degrees Fahrenheit. Therefore, the material used must withstand extremely high temperatures.

The propellant receiving compartment 22 receives a propellant 14. In a preferred embodiment, the propellant is a pellet of compressed powder as shown in FIG. 1. In the most preferred embodiment, the propellant pellet (not shown) has a hole running through the center of the pellet so the entire pellet can ignite. An example of such a propellant product is HODGDON PYRODEX muzzle loading propellant pellets (preformed, non-nitrocellulose based, smokeless charges), available from Hodgdon Powder Company, Shawnee Mission, Kans. In an embodiment, an accelerator (not shown), which is a finer grain of propellant powder capable of igniting a heavier grain of propellant powder, can be attached to the pellet. Other propellant materials are contemplated and include various types of black powder.

In a preferred embodiment, the modular load unit 10 has a removable moisture proof propellant retaining cap 16 as shown in FIGS. 1–10 and 16–18 which fits over the propellant receiving compartment 22, sealing the propellant 14 inside and protecting it from moisture. The propellant retaining cap is removed immediately before the modular load unit is placed into the bore 44 of the barrel 32 of the gun.

With reference to FIGS. 1–5, and 14–18, the projectile receiving compartment 24 is defined in the first end 28 of the hull body 26 and receives a projectile 12. The projectile receiving compartment can be constructed from various materials. In a preferred embodiment, the projectile receiving compartment is constructed from a polymer. Unlike the polymer used for the construction of the propellant receiving compartment, the material or polymer used to construct the projectile receiving compartment does not have to be as resistant to intense heat. For instance, the material used to construct the projectile receiving compartment can be a less thermostable polymer than the polymer used for the propellant receiving compartment.

Figure 23:
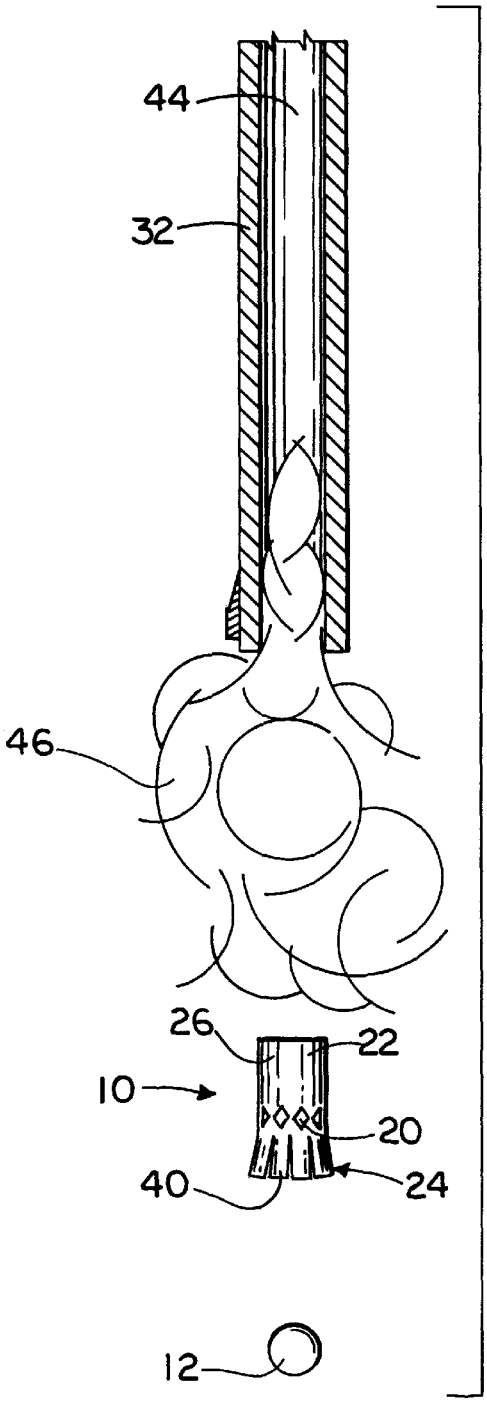
FIG. 23 is a plan view of a discharged modular load unit with a cup having peelaway sides, exiting a sectioned gun barrel.

With reference to FIG. 23, in an embodiment of the present invention, the projectile receiving compartment 24 of the modular load unit 10 is cup-shaped, having a plurality of peelaway sides 40. The projectile 12 is released from the projectile receiving compartment as it is expelled at a high velocity from the barrel 32 of the muzzleloader, propelled by the force produced from hot gases 46 created by the ignition of the propellant. Air resistance due to the high velocity of the expelled projectile causes the peelaway sides to peel outward, in the same fashion as a banana being peeled. The peelaway sides are preferably constructed from a polymer material; however, other materials are contemplated by the inventor. For example, polymers, polyethylene, plastics, fiberglass, rubbers, metals, plant, i.e. cork, wood, cellulosics, composites or any combinations or derivatives thereof may be used.

Figure 24:
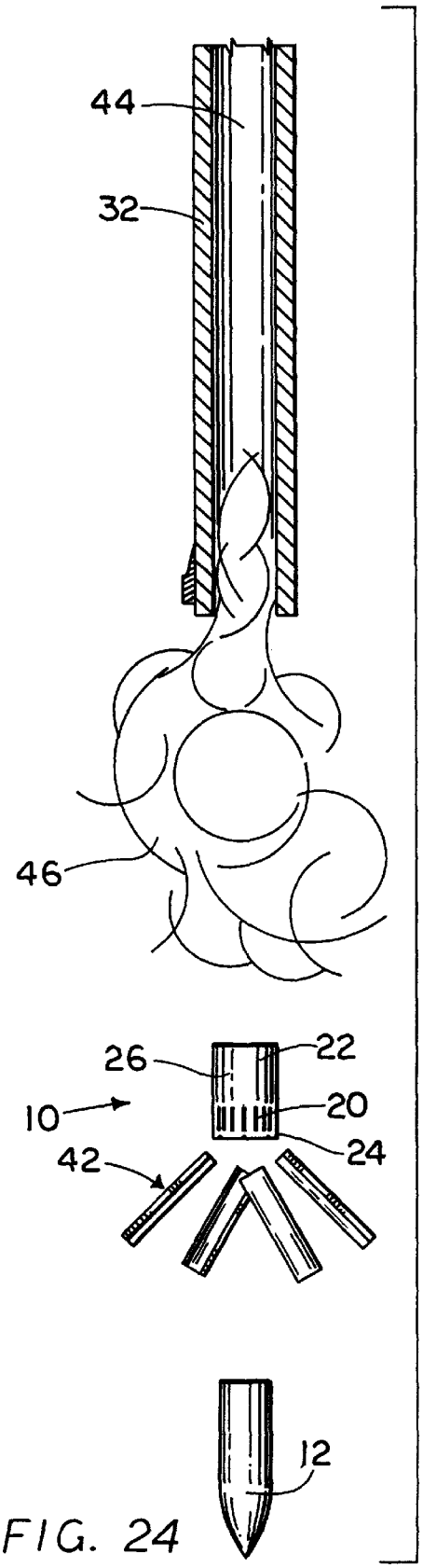
FIG. 24 is a plan view of a discharged modular load unit with a cup having breakaway sides, exiting a sectioned gun barrel.

With reference to FIG. 24, in another embodiment of the present invention, the projectile receiving compartment 24 of the modular load unit 10 is cup-shaped, having a plurality of breakaway sides 42. The breakaway sides simply fall away completely instead of peeling back as occurs with the peelaway sides 40. In yet another embodiment, the entire projectile receiving compartment completely falls away when the muzzle loading firearm is fired, expelling the projectile 12.

Figure 3:
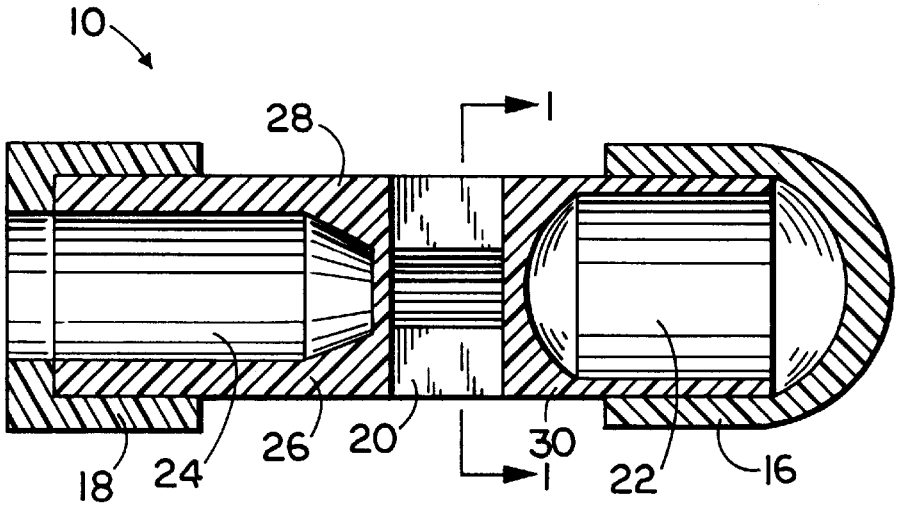
FIG. 3 is a sectional view of an embodiment of an empty modular load unit having a projectile receiving compartment with peelaway sides.
Figure 4:
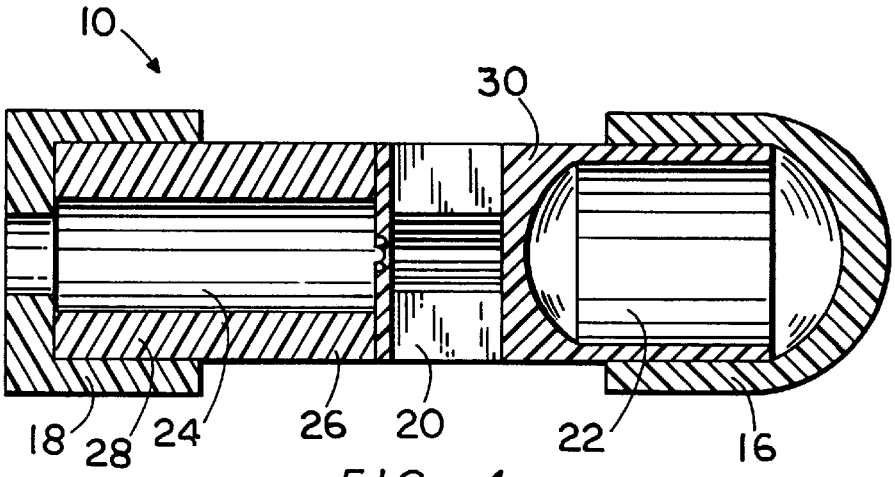
FIG. 4 is a sectional view of an empty modular load unit having a projectile receiving compartment with breakaway sides.
Figure 5:
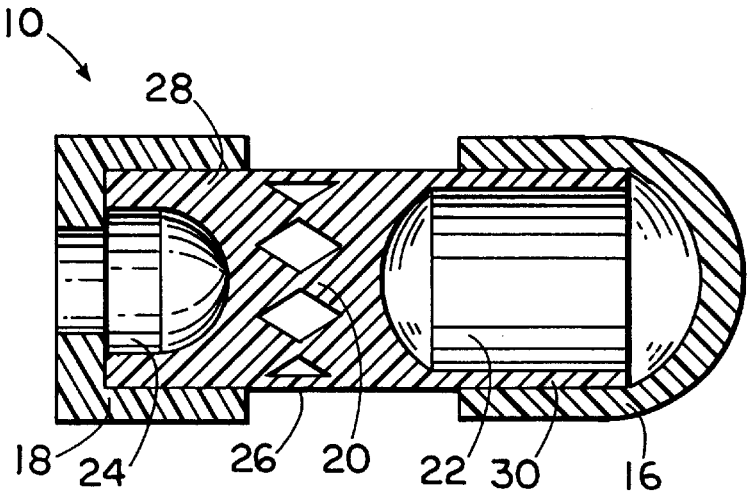
FIG. 5 is a sectional view of an empty modular load unit having a projectile receiving compartment for receiving a round projectile.
Figure 6:
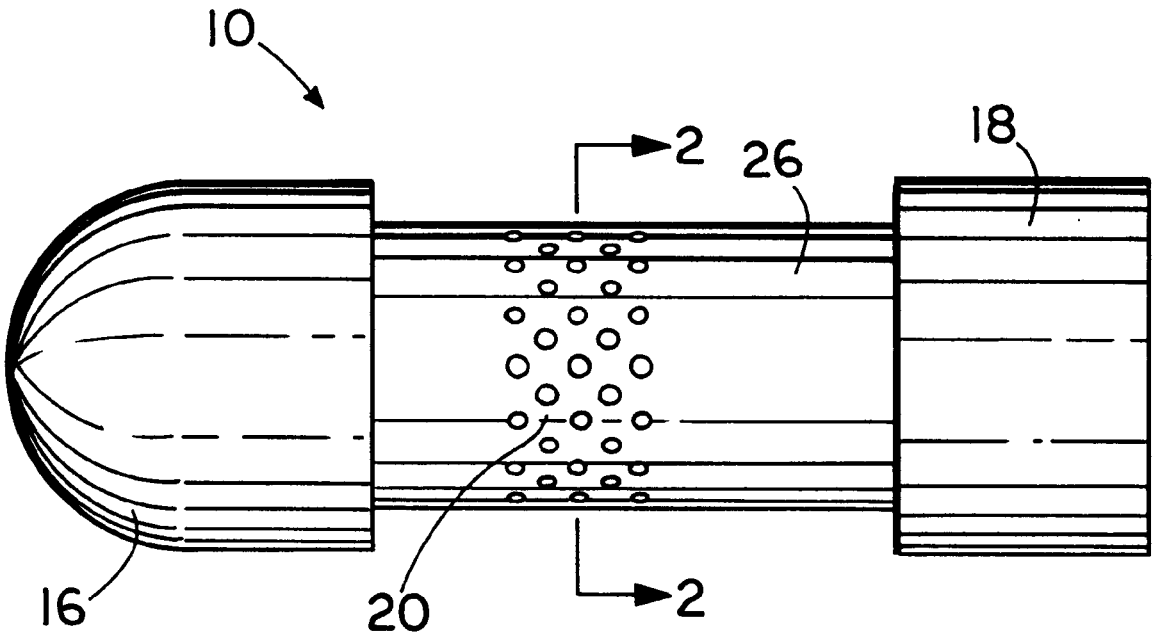
FIG. 6 is a plan view of an empty modular load unit with a propellant retaining cap and a projectile retaining cap.
Figure 7:
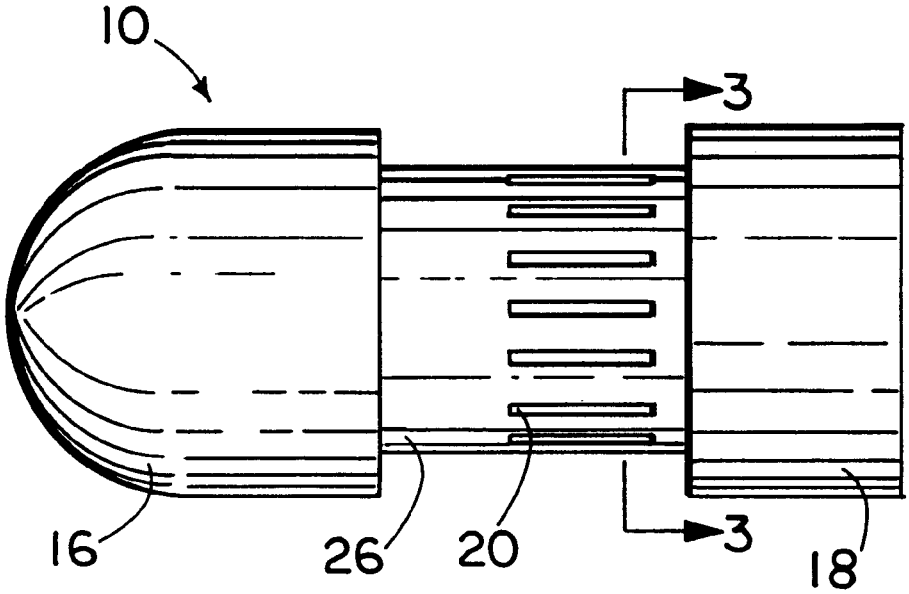
FIG. 7 is a plan view of an empty modular load unit with a propellant retaining cap and a projectile retaining cap.
Figure 10:
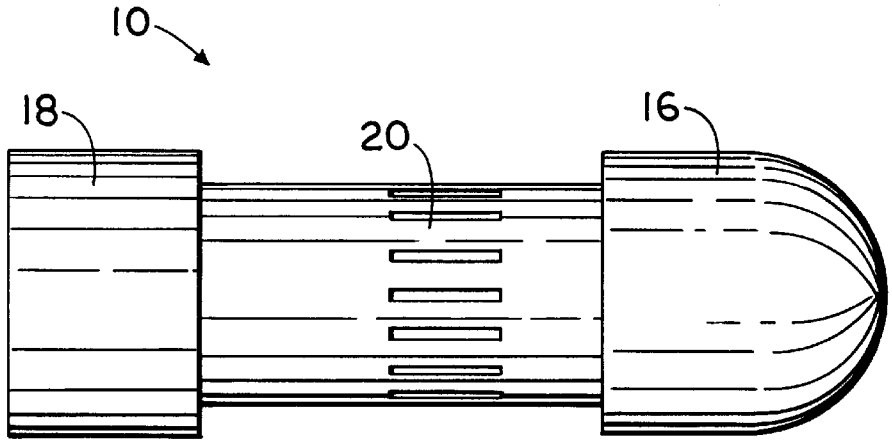
FIG. 10 is a plan view of an empty modular load unit with a propellant retaining cap and a projectile retaining cap.
Figure 9:
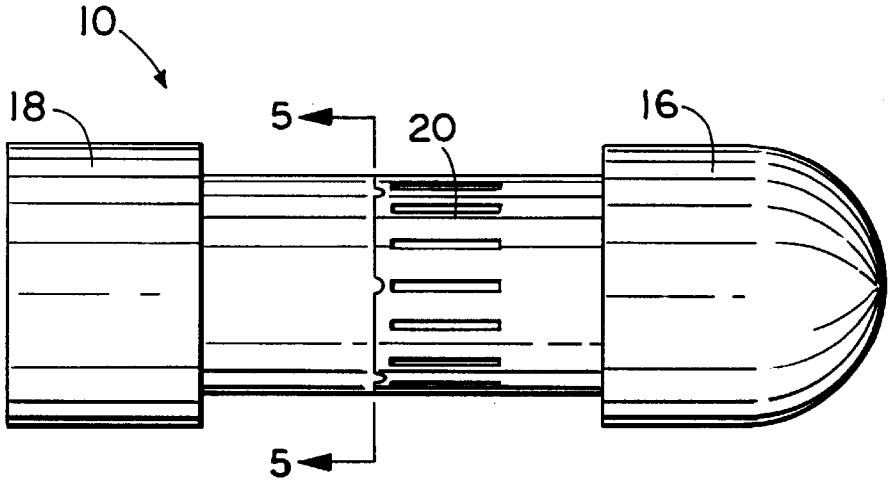
FIG. 9 is a plan view of an empty modular load unit with a propellant retaining cap and a projectile retaining cap.
Figure 8:
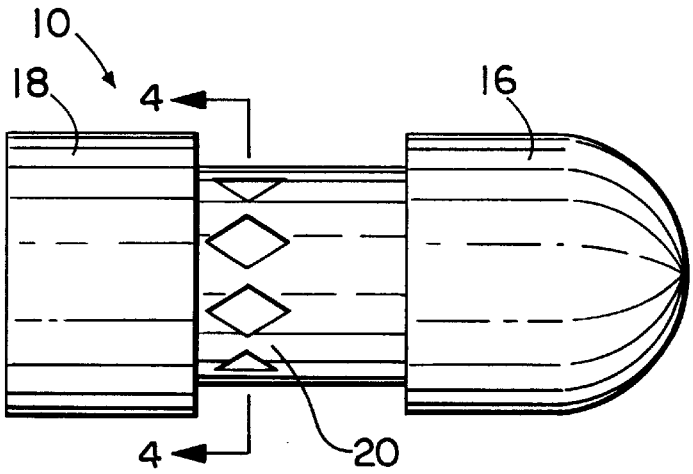
FIG. 8 is a plan view of an empty modular load unit with a propellant retaining cap and a projectile retaining cap.
Figure 11:
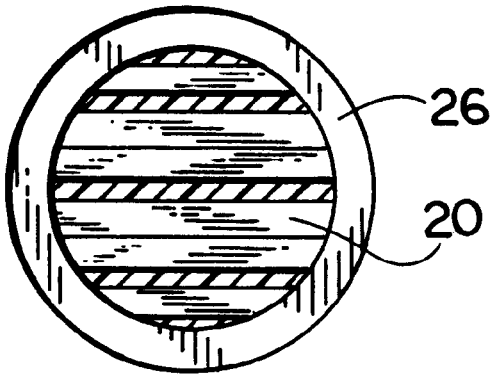
FIG. 11 is a sectional view of a cushion taken on line 2—2 of FIG. 6.
Figure 13:
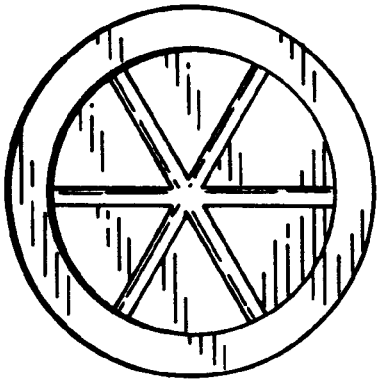
FIG. 13 is a sectional view of a cushion taken on line 5—5 of FIG. 9.
Figure 12:
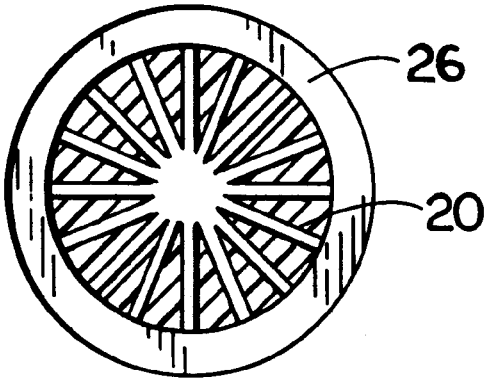
FIG. 12 is a sectional view of a cushion taken on line 3—3 of FIG. 7, line 2—2 of FIG. 6, and line 1—1 of FIG. 3.
Figure 14:
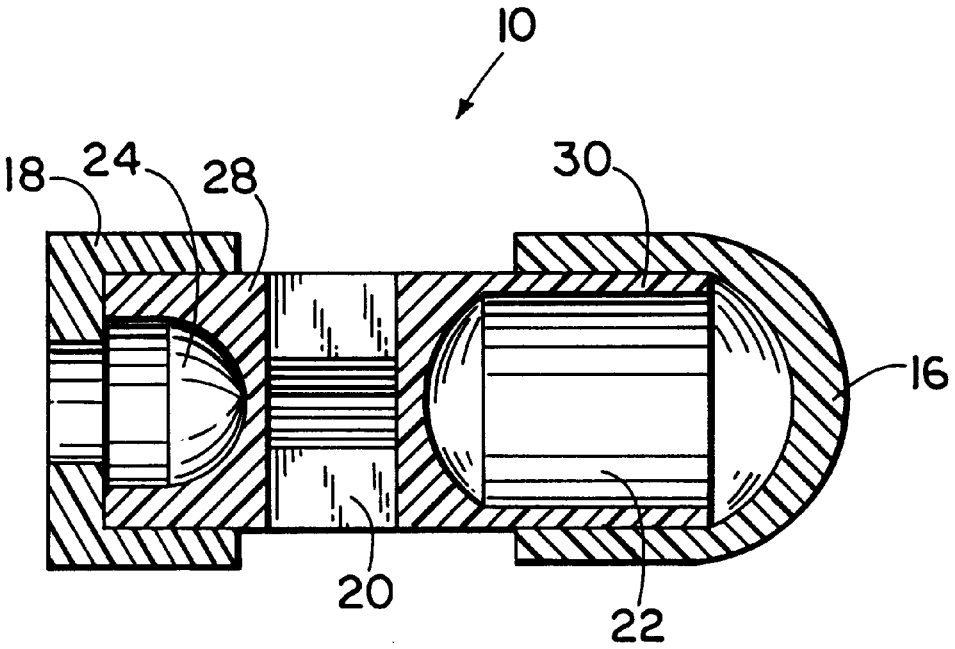
FIG. 14 is a sectional view of an empty modular load unit with a projectile retaining cap and a propellant retaining cap.
Figure 15:
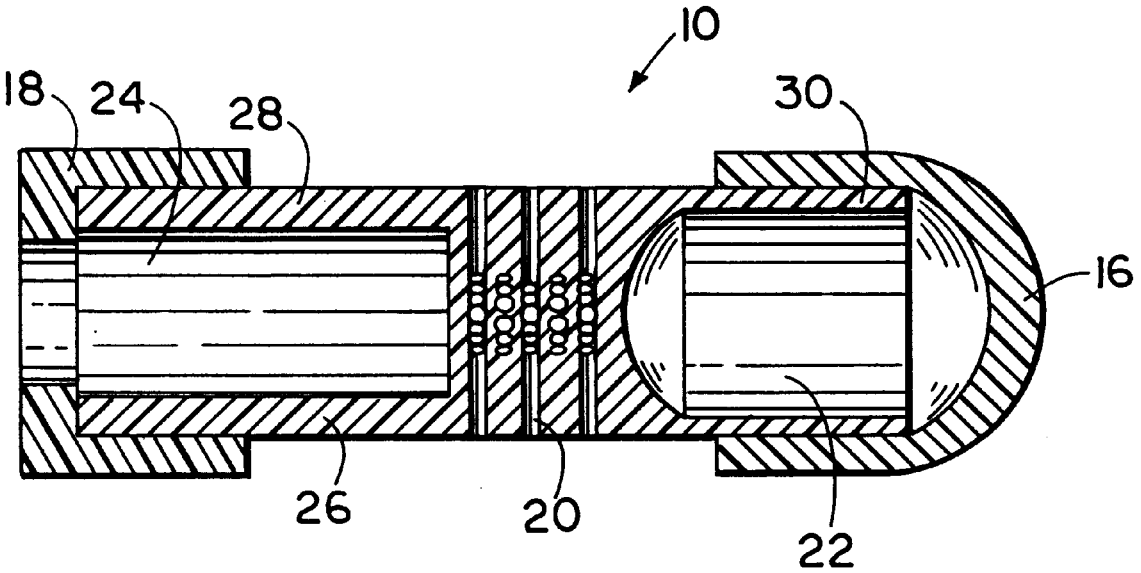
FIG. 15 is a sectional view of an empty modular load unit with a projectile retaining cap and a propellant retaining cap.
Figure 18:
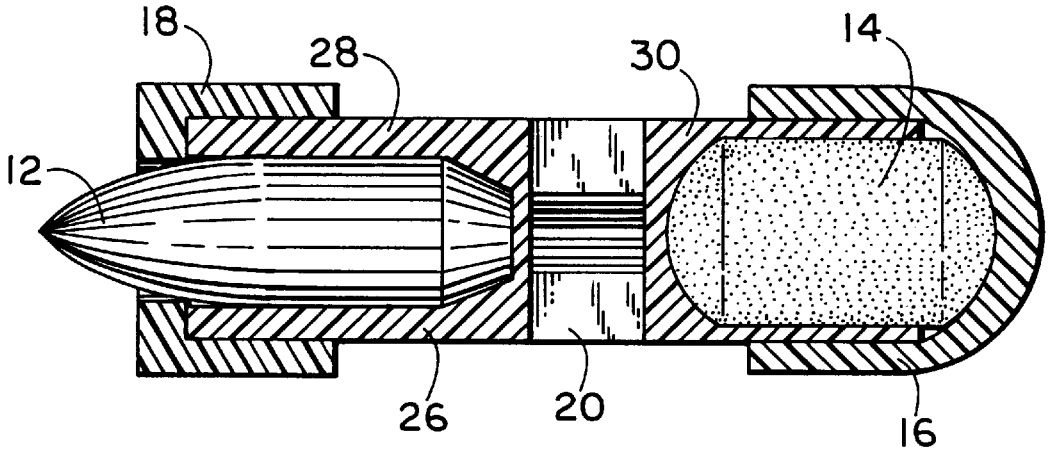
FIG. 18 is a partially sectioned view of a modular load unit with a projectile retaining cap and a propellant retaining cap.
Figure 17:
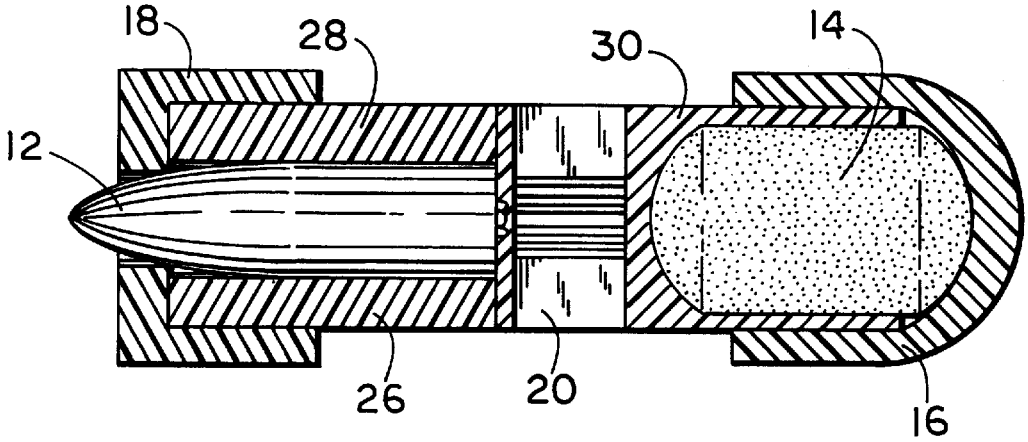
FIG. 17 is a partially sectioned view of a modular load unit with a projectile retaining cap and a propellant retaining cap.
Figure 16:
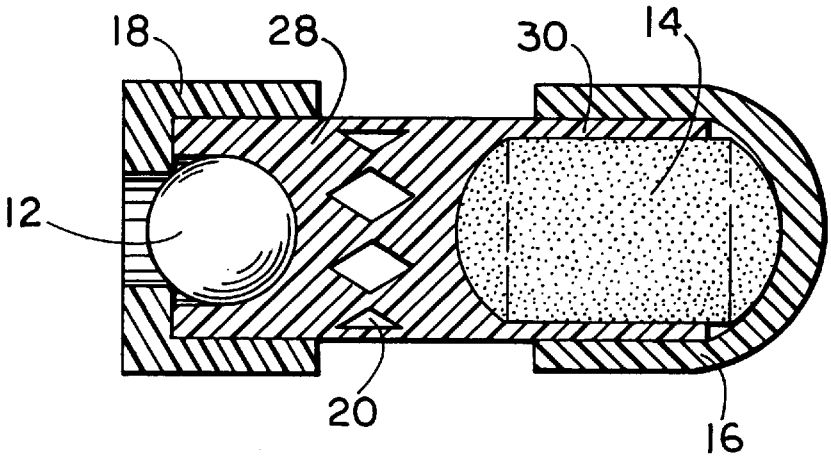
FIG. 16 is a partially sectioned view of a modular load unit with a projectile retaining cap and a propellant retaining cap.

The projectile 12 selected for use in the modular load unit 10 can be of any size or configuration. The projectile is concentric with the hull body 26 of the modular load unit. Examples of projectile types include conical bullets, round balls, the minie, and all-lead projectiles. Boat-tail shaped projectiles, previously unusable with traditional muzzle-loading techniques, can be used with the present invention as shown in FIG. 3. FIG. 3 illustrates a projectile receiving compartment 24 that is compatible with a boat-tail shaped projectile.

Figure 19:
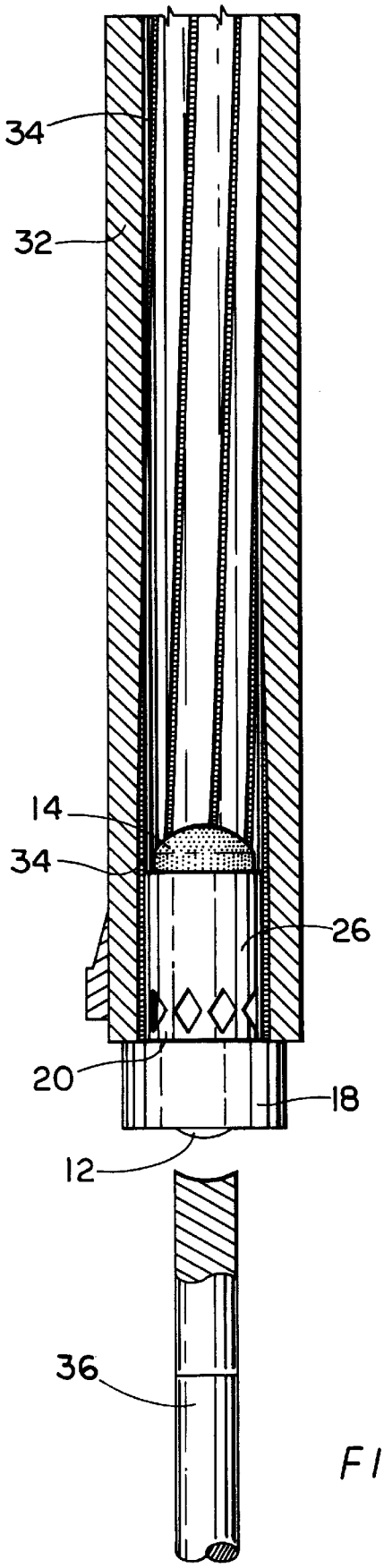
FIG. 19 is a partially sectioned view of a modular load unit with a projectile retaining cap ready to be loaded with a ramrod into a gun barrel.
Figure 20:
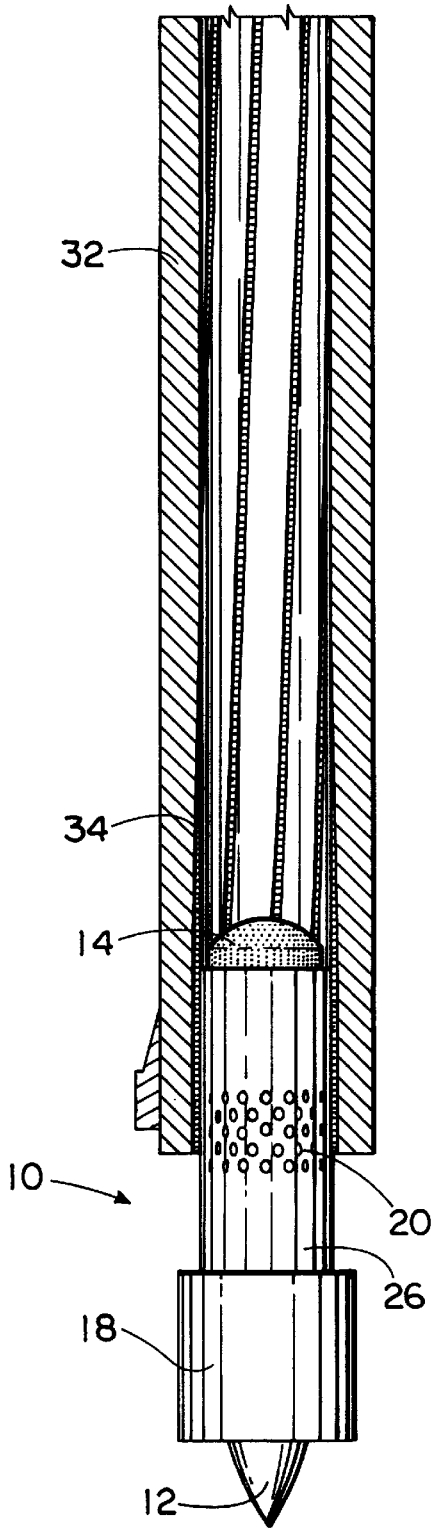
FIG. 20 is a partially sectioned view of a modular load unit with a projectile retaining cap being placed into a gun barrel.

With reference to FIGS. 1–10 and 14–21, the modular load unit 10 has a projectile retaining cap 18 that fits over the projectile receiving compartment 24. In an embodiment, the projectile retaining cap has a hole in the center to enable a bullet tip to fit through when the cap is in place. A ramrod 36 is a loading tool sized to permit removal of the projectile retaining cap as shown in FIGS. 19, 21 and 22. The projectile retaining cap is removable by the ramrod after the modular load unit has been loaded into the bore 44 of the gun. The projectile retaining cap is simply jettisoned with the ramrod after the user hits the projectile retaining cap with the ramrod during the loading process as explained below.

In an alternative embodiment, the projectile retaining cap 18 is constructed from a brittle material so that any size ramrod 36 can be used. If the projectile retaining cap is made from a brittle material, the projectile retaining cap breaks and falls away when you hit the modular load unit 10 with the ramrod, eliminating the need for a special sized ramrod.

With reference to FIGS. 1–24, the modular load unit 10 includes a cushion 20, defined in the hull body 26. The cushion is an integral part of the hull body, located between the propellant receiving compartment 22 and the projectile receiving compartment 24. The cushion 20 prevents the projectile 12 from undergoing the deformation process that typically occurs with the firing of conventionally loaded muzzleloaders. The cushion is expandable upon firing and can be constructed from various materials. For example, polymers, polyethylene, plastics, fiberglass, rubbers, metals, plant, i.e. cork, wood, cellulosics, composites or any combinations or derivatives thereof may be used. Any elastic material, whether natural or synthetic, can be considered in choosing a suitable cushion. In a preferred embodiment, the cushion is constructed from a polymer exhibiting rubberlike elasticity such as elastomers.

The projectile receiving compartment 24, the propellant receiving compartment 22, the cushion 20 and the hull body 26 of the modular load unit 10 can each potentially be constructed from different materials due to differing requirements for heat resistance, obturation, and friction. Obturation is the obstruction caused by great or sudden pressure, i.e. pressure from firing. The propellant receiving compartment and the projectile receiving compartment may be molded into the hull body of the modular load unit.

Figure 2:
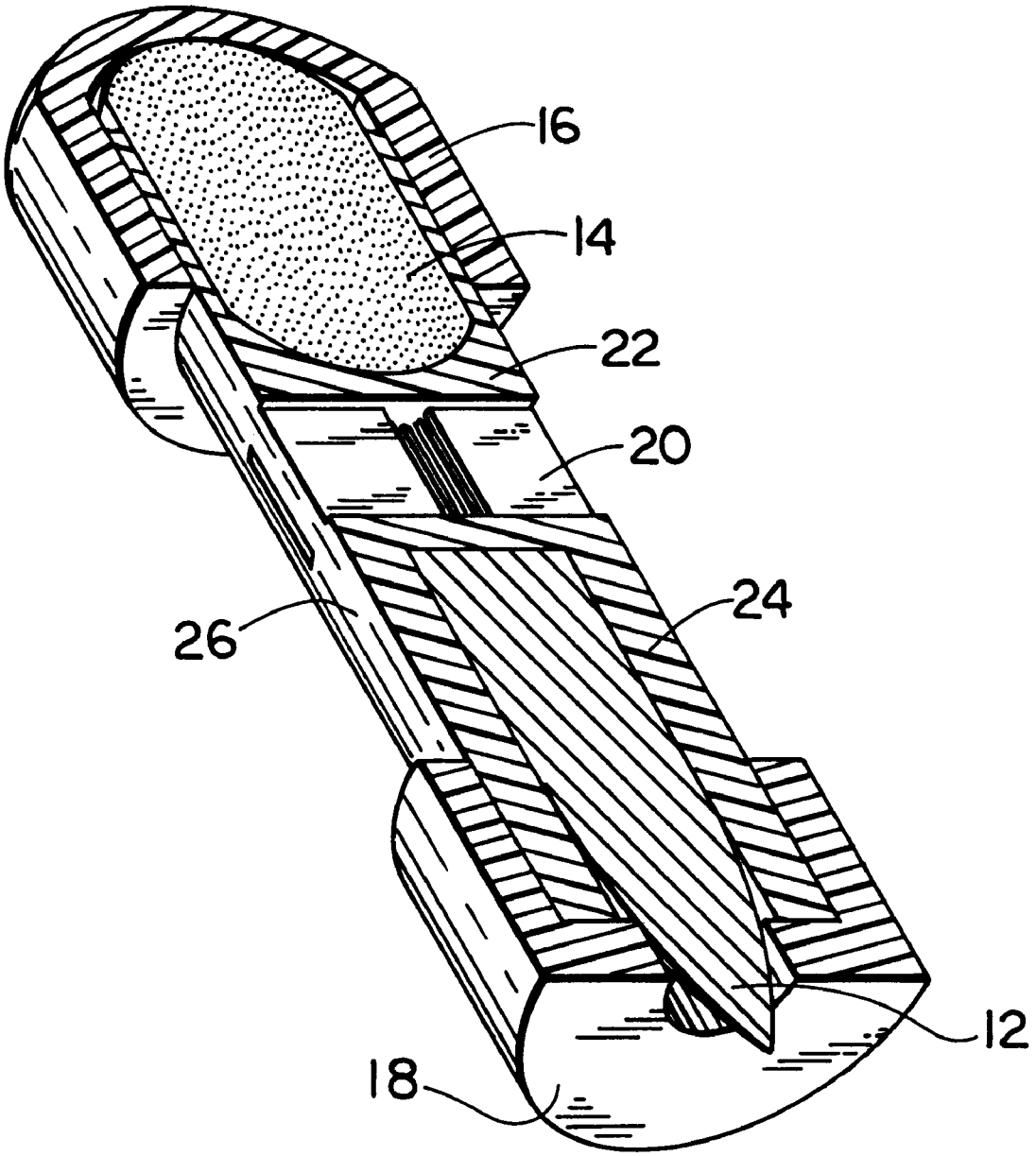
FIG. 2 is a sectional perspective view of a modular load unit with a propellant retaining cap and a projectile retaining cap.

A typical modular load unit 10 contains the projectile 12 in the projectile receiving compartment 24, the propellant 14 in the propellant receiving compartment 22, and a cushion 20 therebetween as shown in FIG. 2. The modular load unit, in this configuration, is ready to quickly load into the muzzle loading firearm at any angle. It is also contemplated by the inventor of the present invention that the modular load unit can be manufactured "empty" or without the propellant, the projectile and the cushion so that users can select the particular projectile, propellant and cushion combinations they want to include within the modular load unit.

To load a muzzleloader using the modular load unit 10, the modular load unit is simply inserted into the barrel 32 of the gun. It is not necessary for the muzzleloader to be held in a vertical position as is required when using loose powder. After the modular load unit is placed in the barrel, it remains perfectly aligned and concentric with the bore 44 because it is substantially the same diameter as the bore, thus increasing accuracy and ballistic performance greatly.

With reference to FIG. 22, the hull body 26 of the modular load unit 10 is expanded into the rifling grooves 34 during the loading process. After the modular load unit is placed into the bore 44, the user compresses the modular load unit with the ramrod 36 or similar device, thereby crushing the propellant 14 against the breech plug 38. This causes an expansion of the propellant receiving compartment 22 and the cushion 20 of the modular load unit into the rifling grooves of the bore, forming a gas tight seal between the modular load unit and the bore of the barrel 32, and eliminating any potentially dangerous "dead space". When the ramrod is withdrawn, the projectile retaining cap 18 falls away from the barrel.

During ignition, which can be from a primer or any external ignition source, the cushion 20 expands, forcing the hull body 26 to lock into the rifling grooves 34 which creates a gas tight seal. With this expansion, a full charge can be attained while the remainder of the hull body serves as a guide for proper bore alignment in the barrel 32. The cushion 20 prevents any projectile 12 deformations caused by obturation from occurring.

With reference to FIG. 22, the cushion 20 and the second end 30 of the hull body 26 defining the propellant receiving compartment 22 expand into the rifling grooves 34, resulting in two points of contact with the rifling grooves, aiding in a reduction of friction. With this reduction of friction and the hull body's low friction coefficient, ballistic performance is increased significantly. During the expansion of both the propellant receiving compartment and the cushion resulting from ignition, the hull body serves as a guide for proper bore alignment in the barrel. The projectile remains concentric in the bore, also increasing ballistic performance.

With reference to FIGS. 23 and 24, upon ignition, the projectile 12 is released from the projectile receiving compartment 24 of the modular load unit 10. Air resistance is produced from hot gases 46 created by the ignition. The heat created by the ignition softens the hull body 26. Under these conditions, the projectile receiving compartment easily opens, expelling the projectile. With reference to FIG. 24, when the projectile exits the bore 44 accelerating, the modular load unit decelerates due to the air resistance and the fall of the plurality of breakaway sides 42 of the projectile receiving compartment.

Additionally, because the hull body 26 of the modular load unit 10 has the same diameter as the bore diameter until fully loaded and fired, no resistance is caused by a fouled barrel 32 during loading. This is due to the fact that the cushion 20 and the propellant receiving compartment 22 of the modular load unit expand after ignition, forcing the hull body into the rifling grooves 34, scraping and pushing the fouling accumulated from the previous shot out of the barrel. Therefore, the use of the muzzle load unit provides cleaning of the barrel that would normally be done by hand separately before or after use of the muzzle loading firearm. Finally, due to the slightly smaller size of the modular load unit as compared to the conventional assemblage of components for muzzle loading firearms, there is little to no resistance from a constricted bore due to prolonged shooting or cold temperatures as seen with conventional loading techniques.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims that follow.

What is claimed is:

1. A modular load unit receivable into a muzzle loading firearm, the modular load unit comprising:

a hull body having a first end and a second end;

a projectile receiving compartment defined in the first end of the hull body;

a propellant receiving compartment defined in a second end of the hull body; and a cushion positioned between the propellant receiving compartment and the projectile receiving compartment.

2. The modular load unit of claim 1 wherein the projectile receiving compartment, the propellant receiving compartment and the cushion are integral with the hull body.

3. The modular load unit of claim 1 further comprising:

a projectile received within the projectile receiving compartment of the modular load unit;

a projectile retaining cap removably received over the projectile;

a propellant received within the propellant receiving compartment; and a propellant retaining cap removably received over the second end of the hull body of the modular load unit.

4. The modular load unit of claim 1 wherein the projectile receiving compartment is cup-shaped.

5. The modular load unit of claim 4 wherein the projectile receiving compartment includes at least one removable breakaway side which breaks away from the projectile receiving compartment, releasing the projectile when the muzzle loading firearm is fired.

6. The modular load unit of claim 4 wherein the the projectile receiving compartment includes at least one peelaway side which peels away from the cup, releasing the projectile when the muzzle loading firearm is fired.

7. The modular load unit of claim 1 wherein wherein the projectile receiving compartment is constructed from a polymer and the propellant receiving compartment is constructed from a polymer with greater thermostability than the polymer forming the projectile receiving compartment.

8. The modular load unit of claim 3 wherein the propellant is a pellet of compressed propellant charge.

9. A modular load unit receivable in a muzzle loading firearm, the muzzle loading firearm having a barrel with a bore and a rifling defined therein, the bore having a bore diameter, the rifling having a rifling diameter greater than the bore diameter, the unit comprising:

a hull body having a first end and a second end;

a projectile receiving compartment defined in the first end of the hull body;

an expandable propellant receiving compartment defined in the second end of the hull body, the propellant receiving compartment having a propellant loading diameter and a propellant firing diameter, the propellant loading diameter substantially equal to the bore diameter of the muzzle loading firearm and the propellant firing diameter substantially equal to the rifling diameter of the muzzle loading firearm such that the muzzle load unit sealingly engages the rifling diameter of the muzzle loading firearm upon firing the muzzle loading firearm; and an expandable cushion defined in the hull body, positioned between the propellant receiving compartment and the projectile receiving compartment, the cushion having a cushion loading diameter and a cushion firing diameter, the cushion loading diameter substantially equal to the bore diameter of the muzzle loading firearm and the cushion firing diameter substantially equal to the rifling diameter of the muzzle loading firearm such that the cushion sealingly engages the rifling diameter of the muzzle loading firearm upon firing the muzzle loading firearm.

10. The modular load unit of claim 9 wherein the hull body is formed from a polymer.

11. The modular load unit of claim 9 further comprising:

a projectile received in the projectile receiving compartment of the modular load unit;

a projectile retaining cap removably received over the projectile;

a propellant received within the propellant receiving compartment; and a propellant retaining cap removably received over the propellant in the propellant receiving compartment of the modular load unit.

12. The modular load unit of claim 9 wherein the projectile receiving compartment is cup-shaped having a plurality of breakaway sides, each of the breakaway sides breaking away when the muzzle loading firearm is fired, releasing the projectile.

13. The modular load unit of claim 11 wherein the projectile receiving compartment is constructed from a polymer and the propellant receiving compartment is constructed from a polymer with greater thermostability than the polymer forming the projectile receiving compartment.

14. The modular load unit of claim 11 wherein the projectile retaining cap is constructed from a brittle material.

15. The modular load unit of claim 11 wherein the propellant is a pellet of compressed propellant charge.

16. A method for loading a muzzle loading firearm, the muzzle loading firearm having a barrel with a bore and a breech plug, the method comprising the steps of:

removing a removable propellant retaining cap from a modular load unit, the modular load unit including a hull body with a first end and a second end, a projectile, a cushion, a propellant and a projectile retaining cap having a center with a hole bored through the center of the projectile retaining cap, the projectile retaining cap removably seated over the projectile;

inserting the modular load unit into the bore with the second end of the hull body placed into the bore first;

ramming a ramrod through the center of the projectile retaining cap and through to the first end of the hull body of the modular load unit to seat the modular load unit against the breech plug of the muzzle loading firearm; and withdrawing the ramrod and the projectile retaining cap.

17. A modular load unit for being received into a muzzle loading firearm, the muzzle loading firearm having a barrel with a bore and a rifling defined therein, the bore having a bore diameter, the rifling having a rifling diameter greater than the bore diameter, the modular load unit having a loading diameter and a firing diameter, the loading diameter being substantially equal to the bore diameter and the firing diameter being substantially equal to the rifling diameter such that the modular load unit sealingly engages the rifling when the muzzle loading firearm is fired, the modular load unit comprising:

a hull body having a first end and a second end;

a projectile receiving compartment defined in the first end of the hull body;

a propellant receiving compartment defined in a second end of the hull body;

a cushion positioned between the propellant receiving compartment and the projectile receiving compartment;

a projectile received within the projectile receiving compartment of the modular load unit; and a propellant received within the propellant receiving compartment of the modular load unit.

18. The modular load unit of claim 17 further comprising:

a projectile retaining cap removably received over the first end of the hull body; and a propellant retaining cap removably received over the second end of the hull body of the modular load unit.

19. The modular load unit of claim 17 wherein the projectile receiving compartment is constructed from a polymer and the propellant receiving compartment is constructed from a polymer with greater thermostability than the polymer forming the projectile receiving compartment.

20. The modular load unit of claim 17 wherein the cushion is constructed from an elastomer.

* * * * *